US005356204A

United States Patent [19]

McDonough

[11] Patent Number: 5,356,204

[45] Date of Patent: Oct. 18, 1994

[54] KNOCK-DOWN CHILD'S CHAIR

[76] Inventor: Michael McDonough, 131 Spring St., New York, N.Y. 10012

[21] Appl. No.: 62,172

[22] Filed: May 17, 1993

[51] Int. Cl.[5] ..... A47C 7/02

[52] U.S. Cl. ..... 297/440.16; 297/440.1; 297/181

[58] Field of Search ..... 297/181, 440.1, 440.13, 297/440.14, 440.15, 440.16, 463; 40/538; 5/907; D6/345, 351, 358, 359

[56] References Cited

U.S. PATENT DOCUMENTS

| | | | |
|---|---|---|---|
| 39,409 | 7/1908 | Augusteen | D6/359 |
| 116,282 | 8/1939 | Dillon | D6/358 |
| 286,824 | 11/1986 | Opsvik | D6/348 |
| 288,151 | 2/1987 | Lindstrom | D6/358 |
| 316,335 | 4/1991 | Karas | D6/345 |
| 2,701,009 | 2/1955 | Richard | 297/440.16 |
| 3,115,367 | 12/1963 | Gariepy . | |
| 3,443,530 | 5/1969 | Carlson | 297/440.1 X |
| 4,066,295 | 1/1978 | Severson | 297/440.16 |
| 4,079,995 | 3/1978 | Beckley | 297/440 |
| 4,994,148 | 2/1991 | Shetka | 162/227 |

FOREIGN PATENT DOCUMENTS

| | | | |
|---|---|---|---|
| 613915 | 12/1960 | Italy | 297/440.1 |

*Primary Examiner*—Kenneth J. Dorner
*Assistant Examiner*—Milton Nelson, Jr.
*Attorney, Agent, or Firm*—Michael Ebert

[57] ABSTRACT

A knock-down chair suitable for a child. The chair includes a rectangular seat having a slot adjacent its rear end to receive the base tongue of a back that is contoured to define a symbol such as a letter of the alphabet or a digit that identifies the chair and its occupant. Attachable to the underside of the seat adjacent each of its four corners is a leg coupling block having a cutout defining a socket to receive the head section of a respective chair leg.

3 Claims, 2 Drawing Sheets

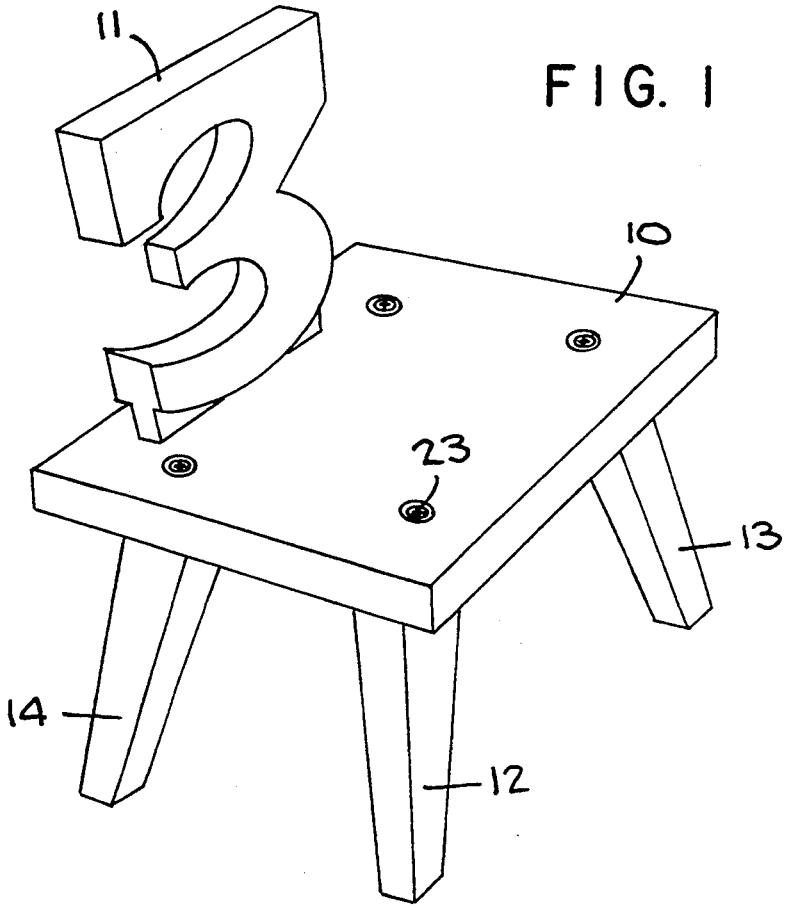
FIG. 1
FIG. 4
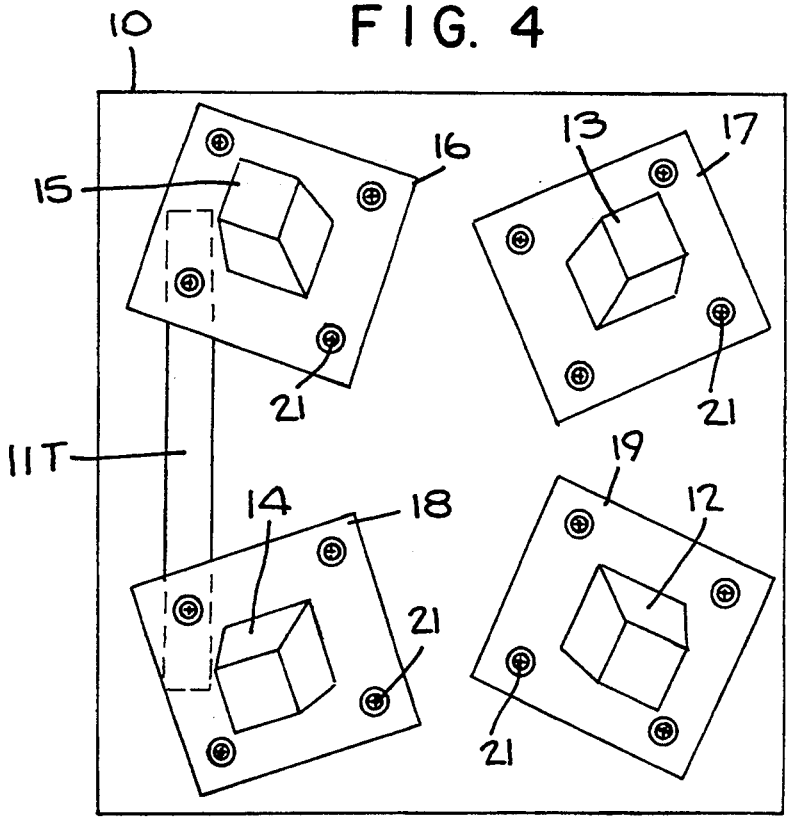

KNOCK-DOWN CHILD'S CHAIR

BACKGROUND OF INVENTION

1. Field of Invention

This invention relates generally to chairs usable by children, and more particularly to a chair of the knock-down type which can easily be assembled and which includes a die-cut back defining a contoured symbol that identifies the chair and the child assigned to it.

2. Status of Prior Art

In kindergartens, playrooms and in other facilities used by children mostly of preschool age, the need exists for chairs in a scale and form that are appropriate to these children. The chairs must be stable and safe in all respects, yet not be too heavy to moved by children.

In a child's development, play performs a vital role; for through play experience a child learns about the structure of different objects and how they function. Thus, a tot, given a play board having apertures therein of different shapes and sizes, and a set of play pieces each having a shape and size that makes it fit into only one of the apertures, in the course of playing with the toy gains an appreciation of form and size relationships.

For children, chairs and tables represent the most fundamental article of furniture, for to eat the child must sit on a chair placed before a table in which food is set, and to play with most toys he must make use of a chair and table for this purpose. Yet while a child will, as a matter of course, observe that both a chair and table have legs which support a seat or a table top, he has no idea of how these structural elements fit together to create an article of furniture. Nor does the child in observing a chair or table having a painted surface have any idea of how this finish is produced.

Playing with a craft toy such as a Lego set teaches a child how structures are created, but not how a commonplace article of furniture, such as a chair, is constructed.

The term "knock-down" furniture refers to chairs or other articles whose unassembled components can be stored in compact shipping boxes, the components being assembled by the purchaser receiving the box. In order, therefore, for furniture to be sold in a knock-down state, it must be possible to put the components together using screws or bolts and simple tools, the components all neatly fitting together. The Dykes U.S. Pat. No. 4,183,154, shows a knock-down chair which can be assembled or disassembled by a child, the components of the chair being color coded and bolted together.

The Beckley U.S. Pat. No. 4,079,995 shows a knock-down chair whose components are held together entirely by screws. The Ratalahti, U.S. Pat. No. 5,026,121, Decurs et al., No. 3,672,723, and Gariepy, No. 3,115,367, show various forms of modular furniture. Design U.S. Pat. No. 322,364 to Smith is of interest, for it shows a child's chair formed of interfitting parts and a back having a heart-shaped cutout.

SUMMARY OF INVENTION

In view of the foregoing, the main object of this invention is to provide a knock-down chair suitable for a child, all components of the chair being die cut from structural fiberboard.

A significant feature of the invention is that the fiberboard from which all components of the chair is made is formed from recycled newspaper, which contains no formaldehyde or other objectionable chemical additives, so that the chair is environmentally safe and well suited for use by children. Moreover, the material is receptive to water-based paints or water colors, so that a child who assembles the chair or participates in its assembly can then decorate the chair in any manner that suits his fancy; and should he wish to later repaint the chair, he can do so, for the chair material can absorb, within its body, water-based paints and colors.

More specifically, an object of the invention is to provide a knock-down child's chair whose components are a rectangular seat, a back in the form of a contoured symbol, such as a digit or a letter of the alphabet, four legs, and coupling blocks to couple the legs to the seat.

A salient feature of the invention is that each chair is individualized by the distinct symbol which constitutes its back; and each child, say, in a kindergarten, can be assigned a chair that is his alone and identifies him, just as a professional baseball player on a team is identified by the number on the back of his uniform. A teacher can then call upon a child by the number or letter on the child's chair, and in doing so make the children in the class aware of how numbers and letters differ from each other. Letters and digits, and how they are combined to create words or numbers, are a primary concern of early education; and by seating children in a class on digit or letter-backed chairs, one creates an environment conducive to such education.

Briefly stated, these objects are accomplished in a knock-down chair suitable for a child. The chair includes a rectangular seat having a slot adjacent its rear end to receive the base tongue of a back that is contoured to define a symbol such as a letter of the alphabet or a digit that identifies the chair and its occupant. Attachable to the underside of the seat adjacent each of its four corners is a leg coupling block having a cutout defining a socket to receive the head section of a respective chair leg.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of a knock-down child's chair in accordance with the invention, as assembled;

FIG. 4 is a bottom view of the chair.

DESCRIPTION OF INVENTION

Figure 2:
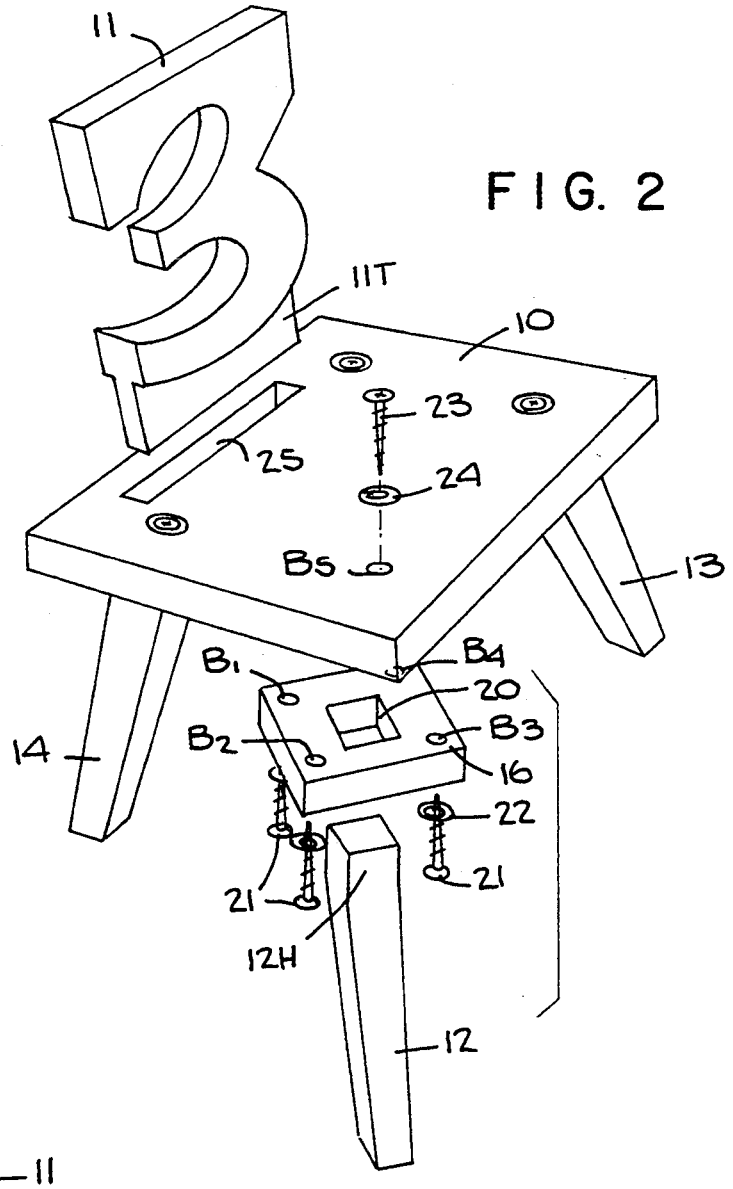
FIG. 2 shows the chair with one leg coupling block and a chair leg separated from the seat.
Figure 3:
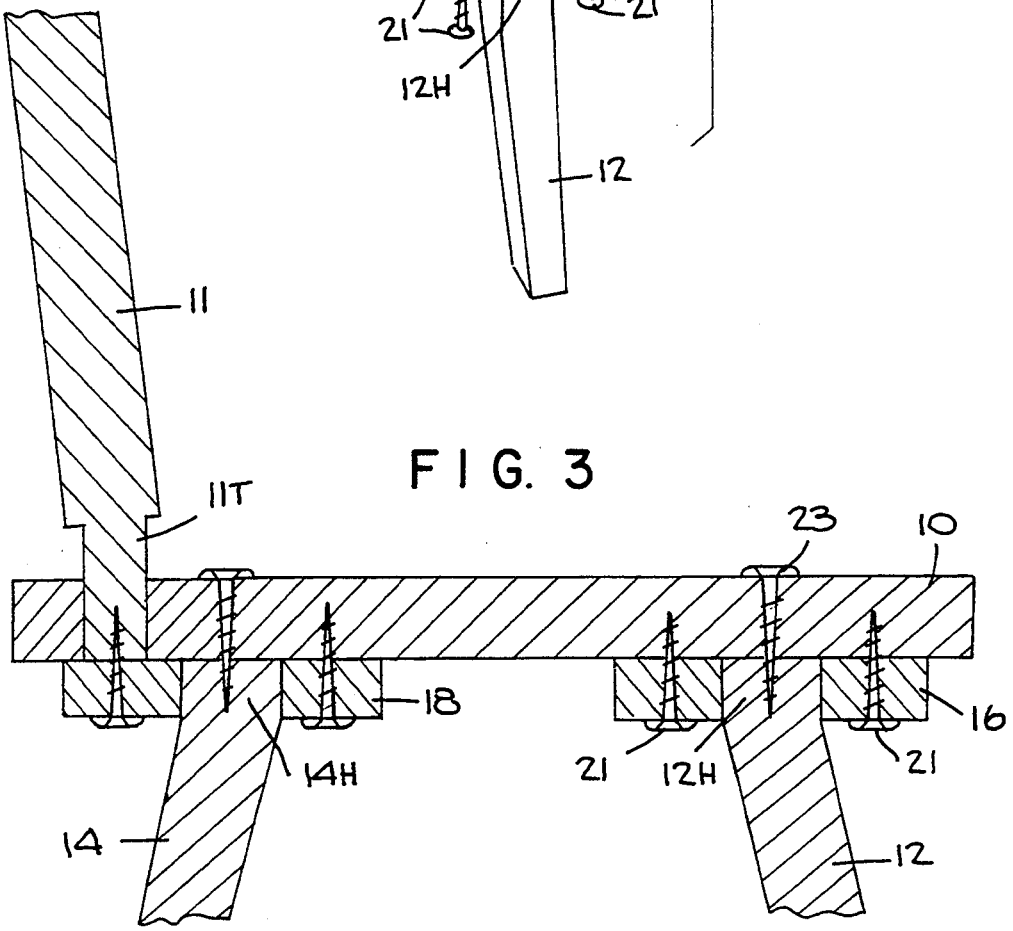
FIG. 3 is a section taken through the seat of the assembled chair showing the manner in which the back and the legs are joined to the seat.

Referring now to the figures of the drawing, illustrated therein is a knock-down child's chair in accordance with the invention, constituted by the following components: a rectangular seat 10, a back 11 in the form of a contoured symbol, which in the embodiment shown is the digit 3, four legs 12, 13, 14 and 15, and rectangular leg-coupling blocks 16, 17, 18 and 19 for coupling the legs to the seat.

The components are all die-cut or otherwise formed of fiberboard, preferably HOMASITE fiberboard made by the Homasite Company of West Trenton, N.J. HOMASITE is a structural fiberboard made entirely of recycled newsprint and free of asbestos and formaldehyde additives. Hence, this fiberboard is environmentally safe and suitable for children's furniture. It is to be understood, however, that the components of the chair may be fabricated of wood, plastic or materials other than fiberboard.

Each coupling block, such as block 16 shown in FIG. 2, is provided with a rectangular cutout defining a socket 20, and pre-bored alignment holes $B_1$ to $B_4$ adjacent the four corners of the block. Each block is secured to the underside of seat 10 adjacent a respective corner of the seat by screws 21 which go through alignment holes $B_1$ to $B_4$ and are threaded into the underside of the seat.

Countersunk washers 22 accommodate the heads of screws 21 to resist turnout forces. In practice, to effect a permanent attachment, the coupling blocks may be glued to the underside of the seat.

Each leg, such as leg 12 shown in FIG. 2, has a rectangular cross section and is tapered, the leg having a head section 12H at its upper end. The head section of each leg is snugly received in socket 20 of the related coupling block. A screw 23 which passes through a pre-drilled hole $B_5$ in the seat, is screwed into the head section of each leg to secure the leg to the seat. Underlying the head of screw 23 is a washer 24. In practice, the head section may be glued to the socket to provide a permanent attachment.

As shown in FIGS. 1 and 2, back 11 is die-cut or otherwise formed to create a contoured symbol in the form of the digit 3. In practice, the symbol may be any digit in the 0 to 9 range, or a letter of the alphabet (A to Z), so that each chair is identified by a distinct symbol which in the environment of a classroom has educational value. Thus, if chairs are provided with backs in the forms of letters A to Z in the alphabet as well as the digits 0 to 9, each child in a large class can be assigned to a chair whose symbol serves to identify the child. And in play activity, chairs can be grouped together to form words such as CAT and DOG and numbers such as 205.

Back 11 is provided with a base tongue 11T that fits into a rectangular slot 25 cut into seat 10 in parallel to its rear edge. This tongue may be glued in place and also secured to the seat by screws which hold the rear coupling blocks 16 and 18 to the seat, as shown in FIG. 4.

In practice, back 11 may be formed of a fiberboard laminate having a core layer sandwiched between front and back layers, tongue 11T being integral with the core layer.

When the chair is assembled by the child, or with the child's assistance, it may be left unfinished, or it may be finished as the user deems fit. HOMASITE, which is an absorbent paper product, is highly receptive to water-based paints. Hence, a child may be provided with stencils and paints and permitted to paint and decorate the chair in a manner that suits the child's fancy. And the chair, after having been painted, may be repainted. Thus, in a kindergarten furnished by twenty knock-down chairs, each chair assigned to a child may have a distinctive finish so that no two chairs look alike and each chair is identified with a particular child.

Instead of a chair, one may provide a knock-down stool, bench or table having the same four legs as a chair but omitting the back. Thus, seat 10 will not have a slot but will be dimensioned to serve as a bench or table top, or as a backless stool.

While there has been shown and described a preferred embodiment of a knock-down child's chair in accordance with the invention, it will be appreciated that many changes and modifications may be made therein without, however, departing from the essential spirit thereof.

I claim:

1. A knock-down chair for a child comprising:

(a) a rectangular seat having a slot parallel to the rear edge of the seat;

(b) a replaceable back formed by a contoured symbol representing a letter of the alphabet or a digit whose shape identifies the chair and distinguishes it from similar chairs having different symbols, said back having a base tongue received in the slot;

(c) four rectangular leg-coupling blocks, each attached to the underside of the seat adjacent a respective corner thereof, each of said leg-coupling blocks having a rectangular cut-out defining a socket;

(d) four legs, each having a rectangular head section received in the socket of a respective block; and (e) each said block is provided with pre-drilled holes at each corner thereof to receive screws for attaching said block to the seat, wherein one of said screws is for screwing into the base tongue to secure the back to the seat.

2. A chair as set forth in claim 1, further including four pre-drilled holes in the seat, each hole being in alignment with the socket in a respective block to receive a screw which is turned into the head section of the leg received in the socket to secure the leg to the seat.

3. A chair as set forth in claim 1, in which the seat, the four blocks and the four legs are formed of fiberboard.

* * * * *